US008057329B2

(12) United States Patent
Cusimano

(10) Patent No.: US 8,057,329 B2
(45) Date of Patent: Nov. 15, 2011

(54) RETRACTABLE COURT STANDARD AND METHODS OF USE

(76) Inventor: Vickie J. Cusimano, Florisant, CO (US)

( * ) Notice: Subject to any disclaimer, the term of this patent is extended or adjusted under 35 U.S.C. 154(b) by 134 days.

(21) Appl. No.: 12/573,002

(22) Filed: Oct. 2, 2009

(65) Prior Publication Data

US 2011/0081995 A1 Apr. 7, 2011

(51) Int. Cl.
*A63B 61/02* (2006.01)

(52) U.S. Cl. ..... 473/492; 473/490; 473/493

(58) Field of Classification Search ..... 473/490–495; 403/109.1–109.8, 378, 379.1, 379.5, 348, 403/349, 353
See application file for complete search history.

(56) References Cited

U.S. PATENT DOCUMENTS

| | | | | | |
|---|---|---|---|---|---|
| 303,012 | A | * | 8/1884 | Murch | 34/89.1 |
| 337,591 | A | | 3/1886 | Lee | |
| 918,579 | A | * | 4/1909 | Horton | 248/353 |
| 1,365,851 | A | * | 1/1921 | Reynolds | 403/107 |
| 1,534,437 | A | | 4/1925 | Wright | |
| 1,604,496 | A | * | 10/1926 | Stevens | 280/240 |
| 2,049,290 | A | * | 7/1936 | Burns et al. | 285/86 |
| 3,933,011 | A | * | 1/1976 | DiGilio et al. | 63/29.1 |
| 4,415,163 | A | | 11/1983 | Schoenig | |
| 4,518,162 | A | * | 5/1985 | Oates | 482/93 |
| 4,720,112 | A | | 1/1988 | Stettner et al. | |
| 4,830,382 | A | | 5/1989 | Wheeler | |
| 4,993,719 | A | * | 2/1991 | Hernandez | 473/492 |
| 5,094,464 | A | * | 3/1992 | Musacchia, Sr. | 473/582 |
| 5,186,197 | A | * | 2/1993 | Lavine | 135/25.4 |
| 5,242,174 | A | | 9/1993 | Koole | |
| 5,358,257 | A | | 10/1994 | Pardi | |
| 5,513,622 | A | * | 5/1996 | Musacchia, Sr. | 124/89 |
| 5,542,679 | A | | 8/1996 | Caso | |
| 5,611,539 | A | * | 3/1997 | Watterson et al. | 473/197 |
| 5,741,084 | A | * | 4/1998 | Del Rio et al. | 403/349 |
| 5,860,877 | A | | 1/1999 | Esser | |
| 5,904,420 | A | * | 5/1999 | Dedoes | 366/198 |
| 6,494,636 | B1 | * | 12/2002 | Mozena | 403/109.2 |
| 6,852,046 | B1 | * | 2/2005 | Wewel et al. | 473/463 |
| 7,100,676 | B2 | * | 9/2006 | Li et al. | 165/80.3 |
| 7,399,243 | B2 | * | 7/2008 | Schank et al. | 473/492 |
| 7,410,431 | B2 | * | 8/2008 | Underwood | 473/492 |
| 7,559,860 | B2 | * | 7/2009 | Underwood | 473/492 |
| 2002/0065153 | A1 | * | 5/2002 | Bertrand | 473/492 |

(Continued)

FOREIGN PATENT DOCUMENTS

| | | |
|---|---|---|
| GB | 8506413 | 3/1985 |

*Primary Examiner* — Raleigh W. Chiu
(74) *Attorney, Agent, or Firm* — Leyendecker and Lemire LLC; Kurt Leyendecker

(57) ABSTRACT

An improved retractable court standard is described. The retractable court standard typically comprises a plurality of elongated tubular sections and an elongated top section. Each of the elongated tubular sections has a top end and a bottom end, and different dimension. Additionally, the elongated top section typically has a top end and a bottom end, and a net securing assembly coupled proximal the top end. At least one elongated tubular section is slidably and rotatably disposed within another circumferentially adjacent elongated tubular section. Importantly, the at least one elongated tubular section has one of at least one rotational locking channel and at least one securing pin. The circumferentially adjacent elongated tubular section has the other of the at least one rotational locking channel and the at least one securing pin. Methods of extending, retracting, and storing the improved retractable court standard are also described.

15 Claims, 13 Drawing Sheets

U.S. PATENT DOCUMENTS

2006/0073922 A1 4/2006 Stambaugh
2007/0129185 A1* 6/2007 Schank et al. ..... 473/492
2007/0270252 A1* 11/2007 Underwood ..... 473/492
2008/0274841 A1* 11/2008 Underwood ..... 473/492
2009/0208282 A1* 8/2009 Hale ..... 403/349
2009/0247330 A1* 10/2009 Underwood ..... 473/493

* cited by examiner

RETRACTABLE COURT STANDARD AND METHODS OF USE

FIELD OF THE INVENTION

The present invention pertains to court standards. More particularly, the present invention pertains to court standards that may be mounted to a court and retracted or self-stored therein.

BACKGROUND

Court standards are used as a base or support for objects, such as nets, for use when playing a sport or game. Court standards are typically permanently mounted or removably mounted to a court. For instance, a large standard to support a volleyball net usually has large, heavy base stand that sits on the court floor to adapted to support the standard. In some instances, a small subsurface well exists into which a small portion of the large standard may be placed.

Transferring large standards such as volleyballs poles can be extremely dangerous. Such large standards are heavy and awkward to carry, particularly if a person or persons are carrying one or more large standards a relatively long distance or up and down a flight of stairs. Additionally, large standards are difficult to store as few (if any) closets or storage areas in school gymnasiums, for instance, have adequate storage space close to the actual court floor. Hence, the large standards are haphazardly placed against a wall or laid on the floor where student and faculty may trip over or otherwise injure themselves. Permanently mounting court standards for various types of sports and activities eliminates the transporting hazards and storing problems, but introduces additional issues such as limited use of the gymnasium floor when the court standard are continually exposed.

Moreover, physical education conducted in a school gymnasium typically includes a variety sports and activities including, but not limited to, volleyball, wheel chair volleyball, tennis, badminton, pickle ball, and tetherball. Therefore, associated court standards sized for the specific sport or activity is typically required. Heretofore, a court standard with a safe, quick, and easy set-up and storage thereof adapted for a plurality of uses remains a desirable apparatus for persons who regularly configure a variety of courts.

DETAILED DESCRIPTION

Figure 1:
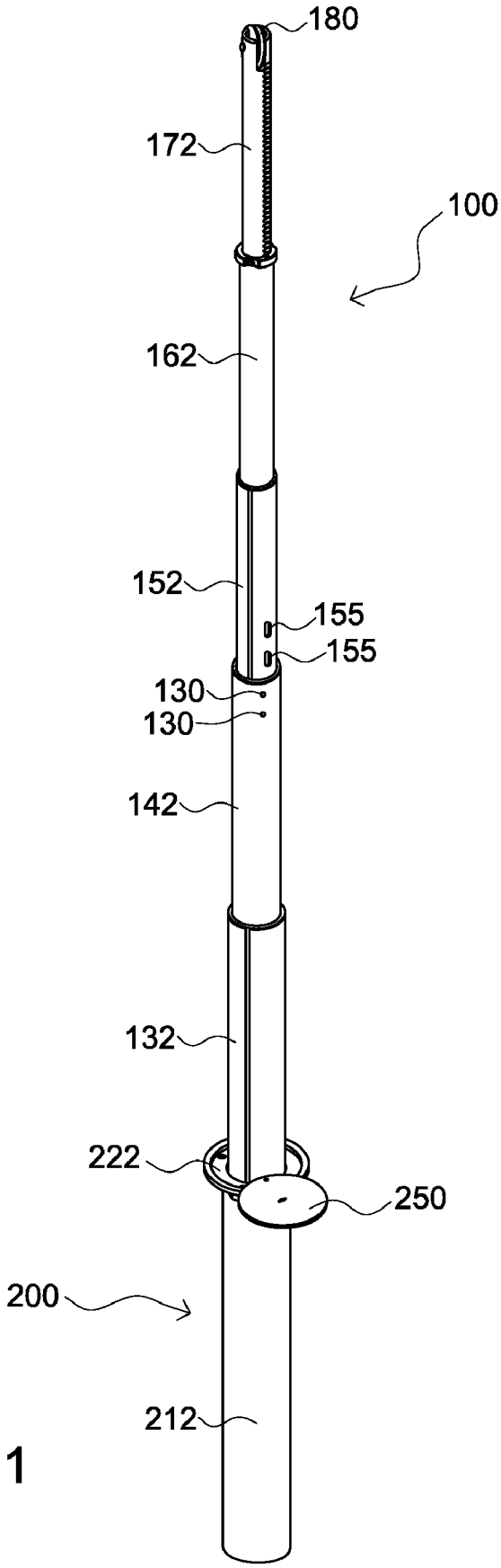
FIG. 1 is a perspective view of a retractable court standard in an extended configuration and associated well according to an embodiment.

Embodiments of the present invention comprise a retractable court standard for securing objects, typically but not necessarily nets, adapted to be raised into a variety of positions and retracted for storage in a subsurface portion of a court. In one exemplary embodiment, the retractable court standard comprises a plurality of elongated tubular sections in conjunction with a top section. The retractable court standard is typically stored subsurface in a well, which can be covered and locked. Importantly, each of the elongated tubular sections typically comprises at least one rotational locking channel. Moreover, each of the elongated tubular sections typically comprises at least one securing pin. The at least one securing pin is adapted to slide through and securely lock with a circumferentially adjacent elongated tubular section thereby enabling the circumferentially adjacent elongated tubular sections to (i) extend and lock to a length greater than each individual section and (ii) retract to a length equal to or approximately equal to the length of the longer of the circumferentially adjacent elongated tubular sections.

In use, one or more embodiments of the retractable court standard are typically raised to an appropriate height for a given height or sport played therewith. After completion of the sport or activity, the retractable court standard is retracted and is typically stored in the well. Benefits of at least some embodiments of the invention include speed and safety while raising and retracting. Rotational locking of adjacent and overlapping elongated tubular sections enables secure and ease of set-up. Moreover, embodiments of the retractable court standards never have to be moved in order to be stored. Retractable court standards can be retracted into a well or another subsurface support structure. By storing the retractable court standard in the subsurface portion of the court, liability due to injury of carrying standards out to the court and off the court is substantially reduced.

Terminology

The terms and phrases as indicated in quotes (“ ”) in this section are intended to have the meaning ascribed to them in this Terminology section applied to them throughout this document including the claims unless clearly indicated otherwise in context. Further, as applicable, the stated definitions are to apply, regardless of the word or phrase’s case, to the singular and plural variations of the defined word or phrase.

The term “or” as used in this specification and the appended claims is not meant to be exclusive rather the term is inclusive meaning: either or both.

References in the specification to “one embodiment”, “an embodiment”, “a preferred embodiment”, “an alternative embodiment” and similar phrases mean that a particular feature, structure, or characteristic described in connection with the embodiment is included in at least an embodiment of the invention. The appearances of the phrase "in one embodiment" in various places in the specification are not necessarily all meant to refer to the same embodiment.

The term "couple" or "coupled" as used in this specification and the appended claims refers to either an indirect or direct connection between the identified elements, components or objects. Often the manner of the coupling will be related specifically to the manner in which the two coupled elements interact.

Directional and/or relationary terms such as, but not limited to, "left", "right", "nadir", "apex", "top", "bottom", "vertical", "horizontal", "back", "front", "lateral", "latitudinal", and "longitudinal" are relative to each other and are dependent on the specific orientation of an applicable element or article, and are used accordingly to aid in the description of the various embodiments and are not necessarily intended to be construed as limiting.

As applicable, the terms "about" and "generally" as used herein unless otherwise indicated mean a margin of +−20%. Also, as applicable, the term "substatially" as used herein unless otherwise indicated means a margin of +−10%. Concerning angular measurements, "about" or "generally" refer to +−10 degrees and "substantially" refers to +−5.0 degrees unless otherwise indicated. It is to be appreciated that not all uses of the above terms are quantifiable such that the referenced ranges can be applied.

The phase "securing pin" as used in this specification and the appended claims refers to a member extending either outwardly or inwardly from a surface of a tubular section in a generally radially direction in relation to axial center of the tubular section. A securing pin is typically located or disposed to be located upon movement along a channel of other guide member of another tubular section. The member extending either outwardly or inwardly is typically cylindrical, but can be any number of shapes such as, but not limited to, conical, square, rectangular, and rounded.

The phrase "rotational locking channel" as used in this specification and the appended claims refers to any type of channel, groove, or guide comprising longitudinal and latitudinal portions that when engaged with one or more securing pins is adapted to substantially lock in place (typically with the aid of gravitation force) two tubular sections that are circumferentially adjacent to each other. Non-limiting examples of rotational locking channels include an L type channel and a double-L type channel described in detail later in this specification.

The term "court" as used in this specification and the appended claims refers to any indoor or outdoor surface primarily utilized for playing a game, sport, or activity. Indoor courts are typically, but not necessarily, comprised of a hardwood surface. However, other indoor courts are comprised of synthetic turf and compacted rubber among other surface types. Outdoor courts include, but are not limited to, sand, grass, clay, dirt, synthetic turf, or asphalt courts.

An Embodiment of a Retractable Court Standard

FIG. 1 is an illustration of a retractable court standard and associated well according to an embodiment. As shown, a retractable court standard 100 is in an extended configuration. The retractable court standard 100 comprises a plurality of elongated tubular sections, each having a substantially circular cross-section. At least one, but typically most of the plurality of elongated tubular sections comprise a rotational locking channel. The rotational locking channel of an elongated tubular section operates with at least one securing pin of another adjacent and overlapping elongated tubular section. Hence, certain adjacent and overlapping elongated tubular section are slidably and rotatably coupled to another.

The exemplary retractable court standard 100 comprises: a first elongated tubular section 132; a second elongated tubular section 142; a third elongated tubular section 152; a fourth elongated tubular section 162; and an elongated top section 172. The elongated top section 172, like the other sections, can be tubular in nature, but need not be since no other section will be slidably and rotatbly coupled therein. The elongated top section 172 further includes a net securing assembly, which includes a pulley 180 adapted to receive a guy wire of a net. The elongated top section 172 typically includes a channel guide (not shown from the perspective view of FIG. 1, but extending generally longitudinally) to keep it from rotating within the fourth elongated tubular section 162. It is pertinent to note that in some embodiments the elongated top section can be the topmost of the plurality of elongated tubular sections with a net securing assembly attached thereto.

One or more securing pins 130 can be seen on the second elongated tubular section 142 proximal a top end. Top and bottom ends as described herein are referenced from the ground or court floor as the various elongated tubular sections exist in an extended configuration. The one or more securing pins 130 inwardly extend toward the axial cavity of the second elongated tubular section 142 and engage with the rotational locking channel (a double-L type channel 120 as more clearly shown in the exploded view of FIG. 2) of the third elongated tubular section 152. Moreover, one or more bores 155 typically, but not necessarily, are located on the third elongated tubular section 152. The one or more bores 155 aid in securing a net when at least one retractable court standard, but more typically two retractable court standards are utilized to create a court comprising a net.

Still referring to FIG. 1, a well 200 operatively coupled to the retractable court standard 100 is shown. The well 200 exists substantially in the subsurface of the court and typically comprises an elongated tubular well section 212, a base section 222, and a cover 250. It is pertinent to note that in some embodiments, the well need not be part of the retractable court standard system. For instance, the first elongated tubular section 132 can comprise a securing means to the floor or ground of a court. However, in an outdoor court application, the well may comprise additional securing means such as an elongated rod affixed to the external bottom thereof and/or cement surrounding the well and adjacent area.

Figure 2:
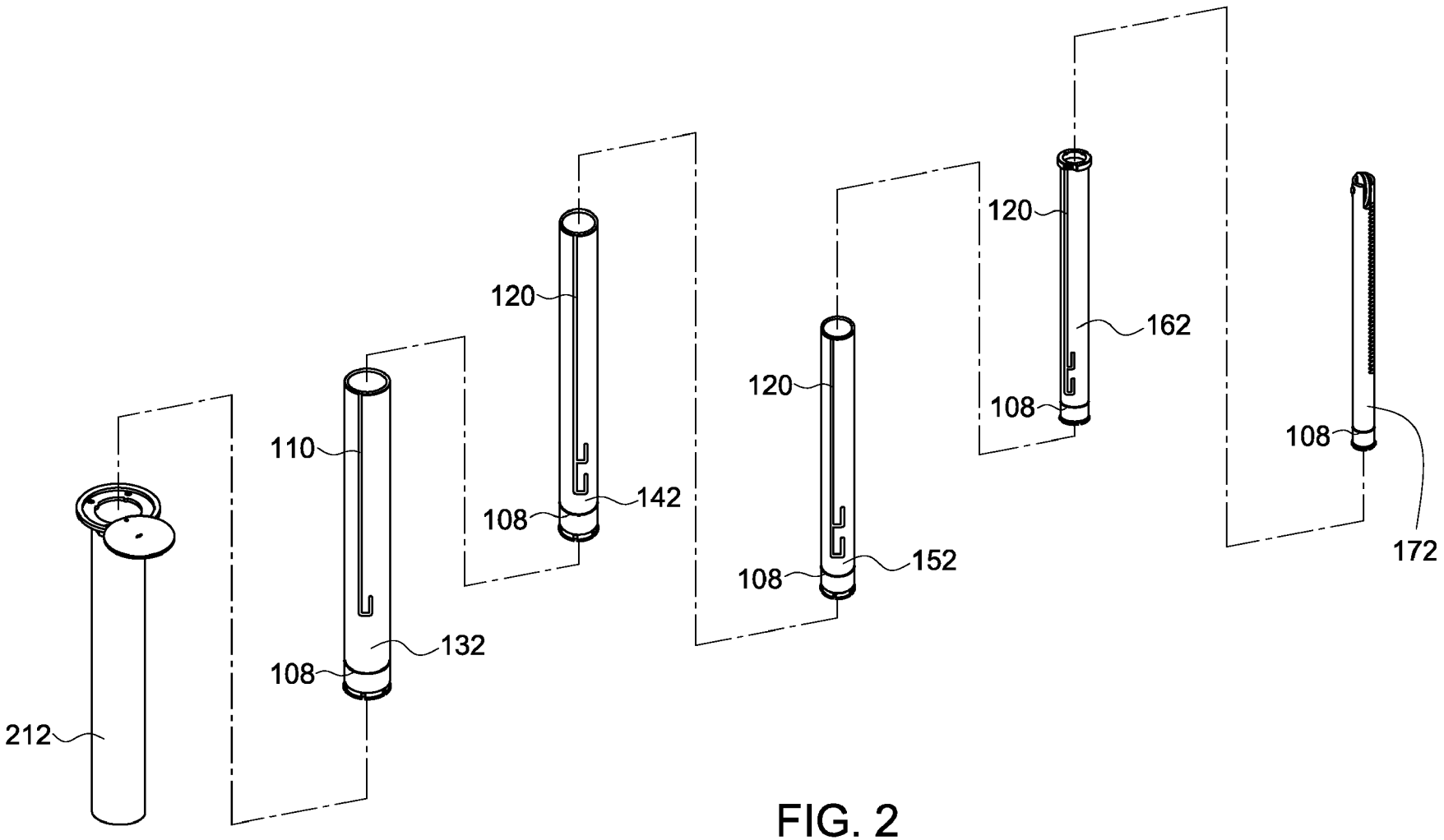
FIG. 2 is an exploded view of a retractable court standard and associated well according to an embodiment.

An exploded view of a retractable court standard and the plurality of elongated tubular sections with the associated well is illustrated in FIG. 2. As can be seen from the exploded perspective view, each of the plurality of elongated tubular sections 132, 142, 152, & 162 and the elongated top section 172 include an O-ring 108. Although the O-ring 108 typically comprises a circular cross-section along the longitudinal axis, the O-ring 108 or other O-ring type seal can comprise a geometrical cross-section such as triangular. The O-ring 108 is typically secured in place by a groove around the outer circumferential surface of the elongated tubular section and essentially creates an internal cavity pressure slowly released to result in a smooth and controlled movement between circumferentially adjacent and overlapping elongated tubular sections. Bottom ends or end portions of each of the plurality of elongated tubular sections 132, 142, 152, & 162 and the elongated top section 172 are typically covered with an aluminum and rubber cap portion or stopper (see stopper 134 shown of FIG. 4, for example) to provide a cushion as one of the sections slides down into another. Moreover, the aluminum and rubber cap portion or stopper stops the inner of two circumferentially adjacent elongated tubular sections from sliding out of the outer of two circumferentially adjacent elongated tubular.

As illustrated in FIG. 2, an L type channel 110 exists on the outer circumferential surface of the first elongated tubular section 132. In fact, a total of three L type channels 110 exist on the outer circumferential surface of the first elongated tubular section 132 although not shown in this perspective view. Additionally, a double-L type channel 120 exists on each of the second elongated tubular section 142, third elongated tubular section 152, and fourth elongated tubular section 162. It is to be appreciated that in some variations the rotational locking channel can be on the inner circumferential surface of the elongated tubular sections. In such a variation, the securing pin would be on the outer circumferential surface of the inside adjacent and overlapping elongated tubular section.

Still referring to FIG. 2, the retractable court standard 100 is typically, but not necessarily, assembled by sliding a smaller diameter elongated tubular section into a bottom end of a larger diameter elongated tubular section without the aluminum and rubber cap portion or stopper attached ensuring that the at least one rotational locking channel on the outer circumferential surface of the smaller diameter elongated tubular section aligns with the at least one securing pin extending inwardly from the larger diameter elongated tubular section. Then, the aluminum and rubber cap portion or stopper for the is attached on the larger diameter elongated tubular sections keeping the smaller diameter elongated tubular section from sliding beyond the bottom end of the larger diameter elongated tubular section as well as creating a smaller cavity area enabling a better air cushion when the smaller diameter elongated tubular section is dropped into the larger diameter elongated tubular section during the retracting process.

For example, the top of the fourth elongated tubular section 162 with its stopper (see stopper 164 shown on FIG. 6A) attached can be inserted through the bottom of the third elongated tubular section 152. The stopper can then be attached to the third elongated tubular section 152. The top end of the third elongated tubular section 152 can be inserted into the bottom end of the second elongated tubular section 142. The stopper can then be attached to the second elongated tubular section 142. Next, the top end of the second elongated tubular section 132 can be placed in the bottom end of the first elongated tubular section 132. The stopper can then be attached to the first elongated tubular section 132. Additionally, the elongated top section 172 can be placed within the top opening of the fourth elongated tubular section 162. Moreover, the first elongated tubular section 132 with all of the other smaller diameter elongated sections therein can be placed into the opening of the well 200 installed substantially in the subsurface of a court or court floor.

Typically, but not necessarily, there should be at least four inches of overlapping longitudinal length between each of the circumferentially adjacent elongated tubular sections when in their fully extended positions. As such the securing pins 130 and rotational locking channels, including but not limited to, the L type channels 110 and double-L type channels 120 may be configured on the elongated tubular sections in a manner to allow such overlapping. Further, the securing pins 130 in the first through fourth elongated tubular sections 132, 142, 152, & 162 are typically located 180 degrees opposite of each other in an alternating fashion. Moreover, the elongated tubular section can have some tapering throughout its entirety or a portion thereof.

The elongated tubular sections are typically constructed of aluminum with a hard anodized finish. For instance, in one embodiment, the elongated tubular portions are made of 6061-T-6, type II, class II, hard anodized, scratch resistant aluminum. The aluminum design allows the total weight to be approximately 29 pounds in one embodiment. Hence, ease of raising and retracting the court standard is enhanced. However, various materials may be used to construct the elongated tubular portions of the court standard such as, but not limited to, various types of metals, plastics, ceramics, and wood.

Additionally, in one embodiment the first and second elongated tubular sections 132 & 142 are approximately 31 inches in length (longitudinally) and the third and fourth elongated tubular sections 152 & 162 and the elongated top section 172 are approximately 25 inches in length (longitudinally). Moreover, as the plurality of elongated tubular section 132, 142, 152, & 162 are circumferentially adjacent and overlapping each other, as well as the elongated top section 172 being within the fourth elongated tubular section 162, each has a different diameter.

Figure 3:
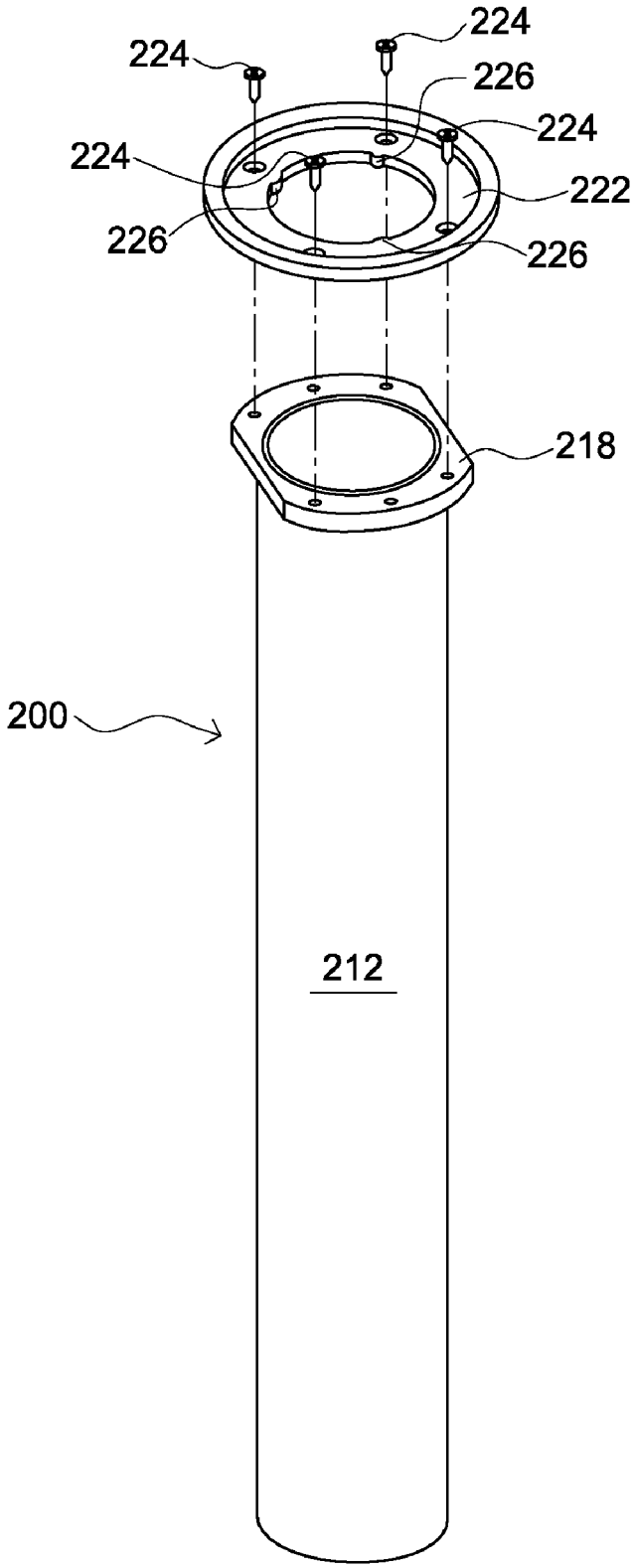
FIG. 3 is a perspective view of a well adapted to secure and receive a retractable court standard according to an embodiment.

FIG. 3 is a perspective view of the well 200. The base section 222 is typically coupled to a flange portion 218 of the elongated tubular well section 212 by a plurality of screws 224. Importantly, one or more securing protrusions 226 that extend inwardly from the inside circumferential edge of the opening of the base section 222 of the well 200 act similarly to securing pins for the first elongated tubular section 132 and the L type channels 110 thereon as will become more apparent below.

Figure 4:
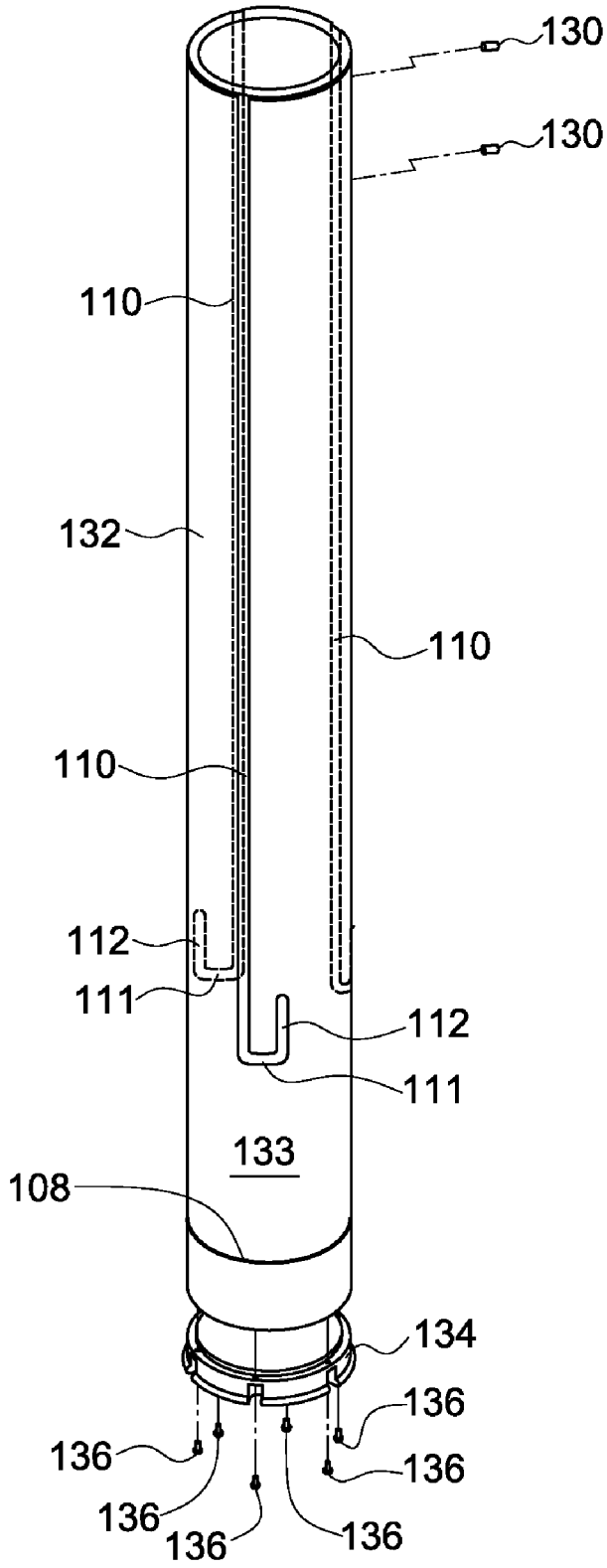
FIG. 4 is a perspective view of an elongated tubular section of a retractable court standard according to an embodiment.

Now referring to FIG. 4, the first elongated tubular section 132 is illustrated in more detail. A stopper 134 is coupled to the bottom of the first elongated tubular section 132 by a plurality of screws 136. The three L type channels 110 on an outer circumferential surface 133 of the first elongated tubular section 132 each comprise an extended longitudinal channel portion with a latitudinal channel portion 111 and a longitudinal locking channel portion 112. Additionally, two securing pins 130 are inserted proximal the top of the first elongated tubular section 132 inwardly extending toward the axial cavity and engaging with the double-L type channel 120 of the second elongated tubular section 142.

Figure 5:
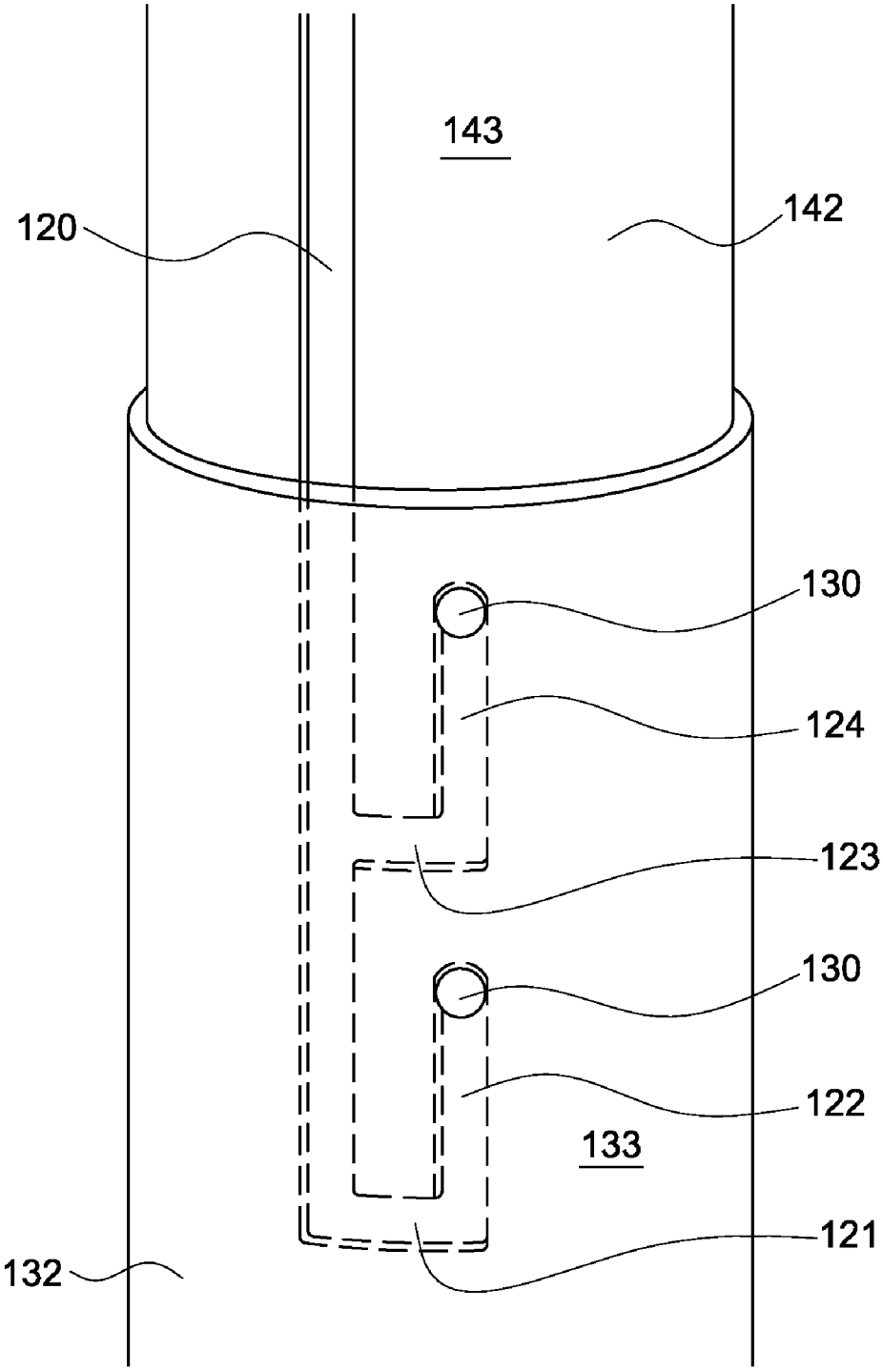
FIG. 5 is a close-up perspective view of two adjacent elongated tubular sections that are extended and locked in place according to an embodiment.

FIG. 5 is a close-up perspective view of the first elongated tubular section 132 and the second elongated tubular section 142 exemplary of two adjacent elongated tubular sections extended and locked in place. As indicated, the two securing pins 130 of the first elongated tubular section 132 inwardly extend toward the axial cavity and engage with the double-L type channel 120 of the second elongated tubular section 142. In some embodiments, the outer end portions of the securing pins 130 can be seen through the outer circumferential surface 133 of the first elongated tubular section 132. However, in other embodiments, the securing pins can be integrated into the mold of their respective elongated tubular sections thereby having no outer edge portion.

As shown in more detail in FIG. 5, the double-L type channel 120 comprises an extended longitudinal channel portion with a lower latitudinal channel portion 121, a lower longitudinal locking channel portion 122, an upper latitudinal channel portion 123, and an upper longitudinal locking channel portion 124. The securing pins 130 as shown extending through a bore in the first elongated tubular section 132 extend beyond inner circumferential surface towards the axial cavity and center. The extended portions of the securing pins 130 are slidably and rotatbly engaged with the double-L type channel 120 of the second elongated tubular section 142. Hence, the diameter of the securing pins 130 necessarily needs to be equal to or slightly less than the diameter of the double-L type channel 120 and all portions thereof. As illustrated, the first elongated tubular section 132 and the second elongated tubular section 142 are extended and securely locked in place whereby the securing pins 130 are affixed within the lower and upper longitudinal locking channel portions 122 & 124.

Figure 6A:
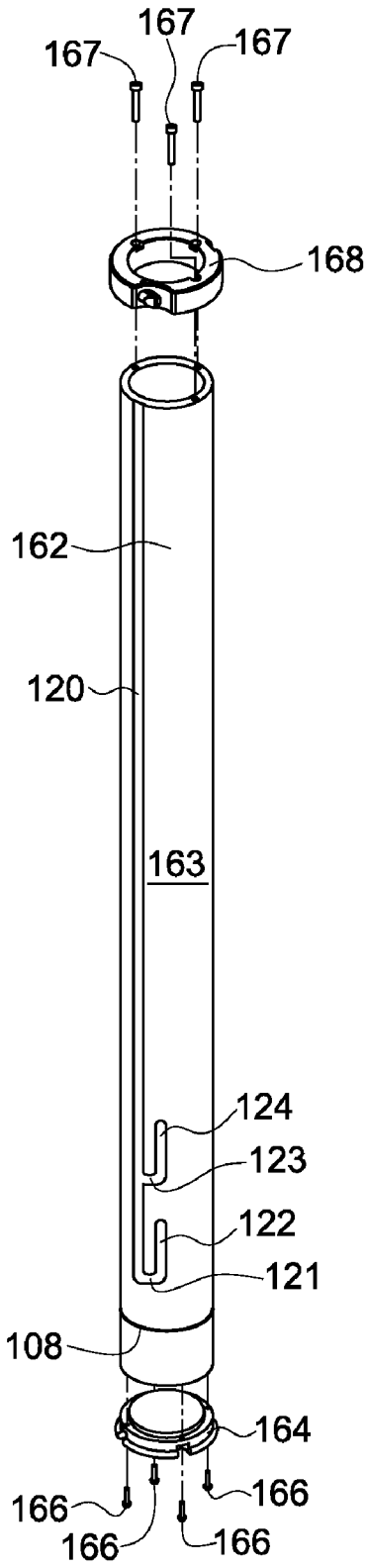
FIG. 6A is a perspective view of an elongated tubular section of a retractable court standard with a clamping mechanism according to an embodiment.

Referring now to FIG. 6A, the fourth elongated tubular section 162 is illustrated. An outer circumferential surface 163 of the fourth elongated tubular section 162 includes the double-L type channel 120. Similar to other elongated tubular sections, the double-L type channel 120 comprises the extended longitudinal channel portion with the lower latitudinal channel portion 121, the lower longitudinal locking channel portion 122, the upper latitudinal channel portion 123, and the upper longitudinal locking channel portion 124. O-ring 108 is also shown on the outer circumferential surface 163 of the fourth elongated tubular section 162. A stopper 164 is coupled to the fourth elongated tubular section 162 by a plurality of screws 166 on a bottom end. On a top end, the clamping mechanism 168 is coupled to the fourth elongated tubular section 162 by three screws 167.

Figure 6B:
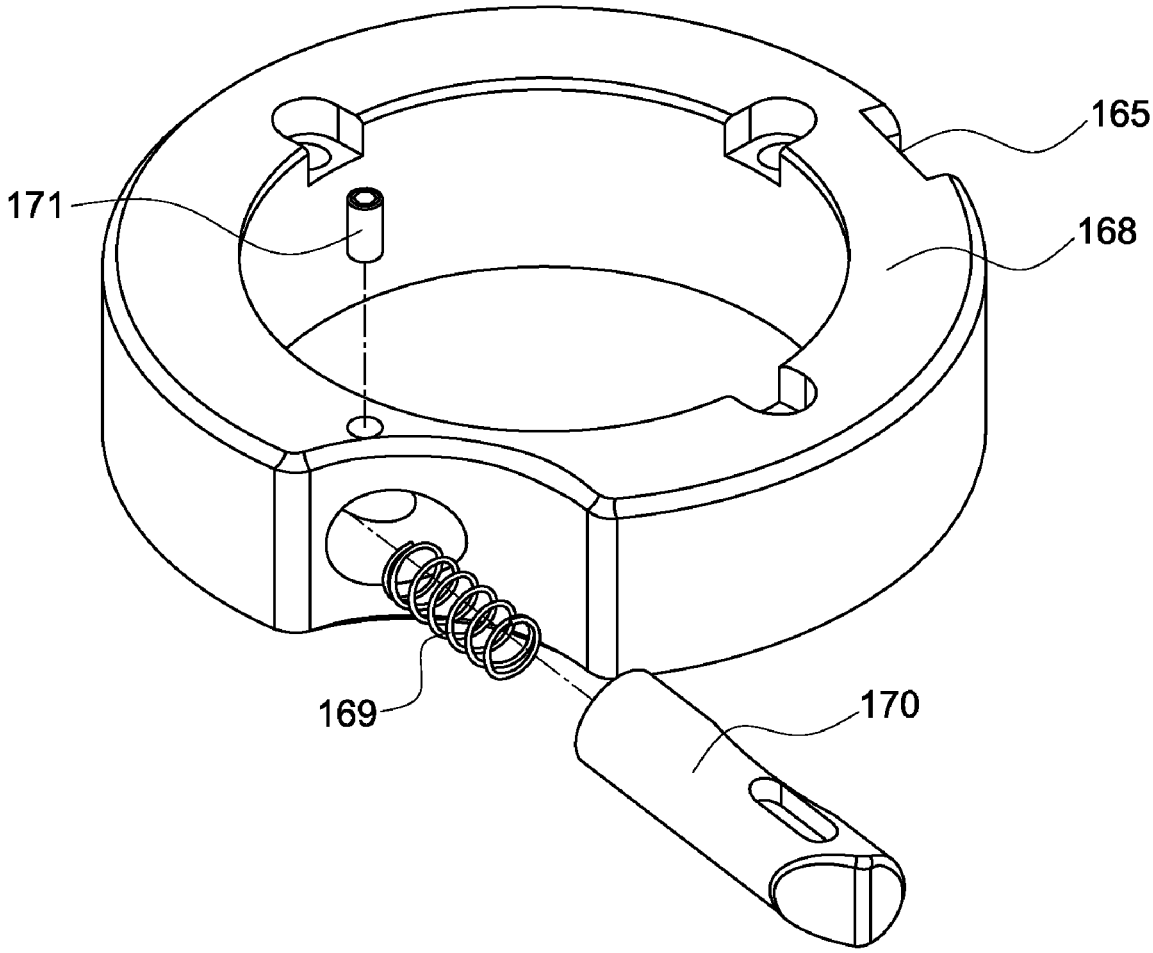
FIG. 6B is a close-up perspective view of a clamping mechanism utilized in a retractable court standard according to an embodiment.

FIG. 6B is a close-up view of the clamping mechanism 168. The clamping mechanism 168 is a generally ring-shaped mechanism that attaches to the top edge of the fourth elongated tubular section 162 adapted to enable the elongated top section 172 to be fixably moveable within the fourth elongated tubular section 162 and releasably locked therewith. Important to its operation, the clamping mechanism 168 includes a button 170, a biasing mechanism 169, and a rod 171. The clamping mechanism 168 includes three longitudinal bores that are aligned to intersect with the top end of the fourth elongated tubular section 162 and longitudinal bores therein to receive three screws 167 (refer back to FIG. 6A).

As can be seen in FIG. 6B, a longitudinal bore for receiving the generally cylindrical rod 171 extends through a portion of the thickness (longitudinally) of the clamping mechanism 168. A slot 165 extending longitudinally on a side edge of the clamping mechanism 168 allows the clamping mechanism 168 to slide past the securing pin 130 of the second elongated tubular section 142 when being extended or retracted. Additionally, a latitudinal bore for receiving and allowing movement of the button 170 extends through a portion of the clamping mechanism 168. The longitudinal bore for receiving the rod 171 intersects generally perpendicularly with the latitudinal bore for receiving the button 170. Movement of the button is achieved by a first end of the biasing mechanism 169 in contact with an inside end of the latitudinal bore and a second end of the biasing mechanism 169 in contact with a back end of the button 170. A spring typically serves as the biasing mechanism 169, however, other types of biasing mechanisms are contemplated. The movement of the button 170 is limited by a bottom end of the rod 171 extending though the longitudinal bore for receiving the rod 171 whereby the bottom end of the rod 171 is fitted into a top channel of the button 170.

The button 170 is generally cylindrical having an arcuate cutout along a portion thereof. The arcuate cutout is of a substantially similar radial dimension of the as inner circumference of the generally ring-shaped clamping mechanism. When the button 170 is depressed, the arcuate cutout is aligned with the inner circumference or inner aperture of the clamping mechanism 168 thereby enabling the elongated top section 172 to travel therethrough. However, when the button 170 is not depressed a cylindrical portion without the arcuate cutout extends through a cross-sectional area of the inner circumference or inner aperture of the clamping mechanism 168.

Figure 7:
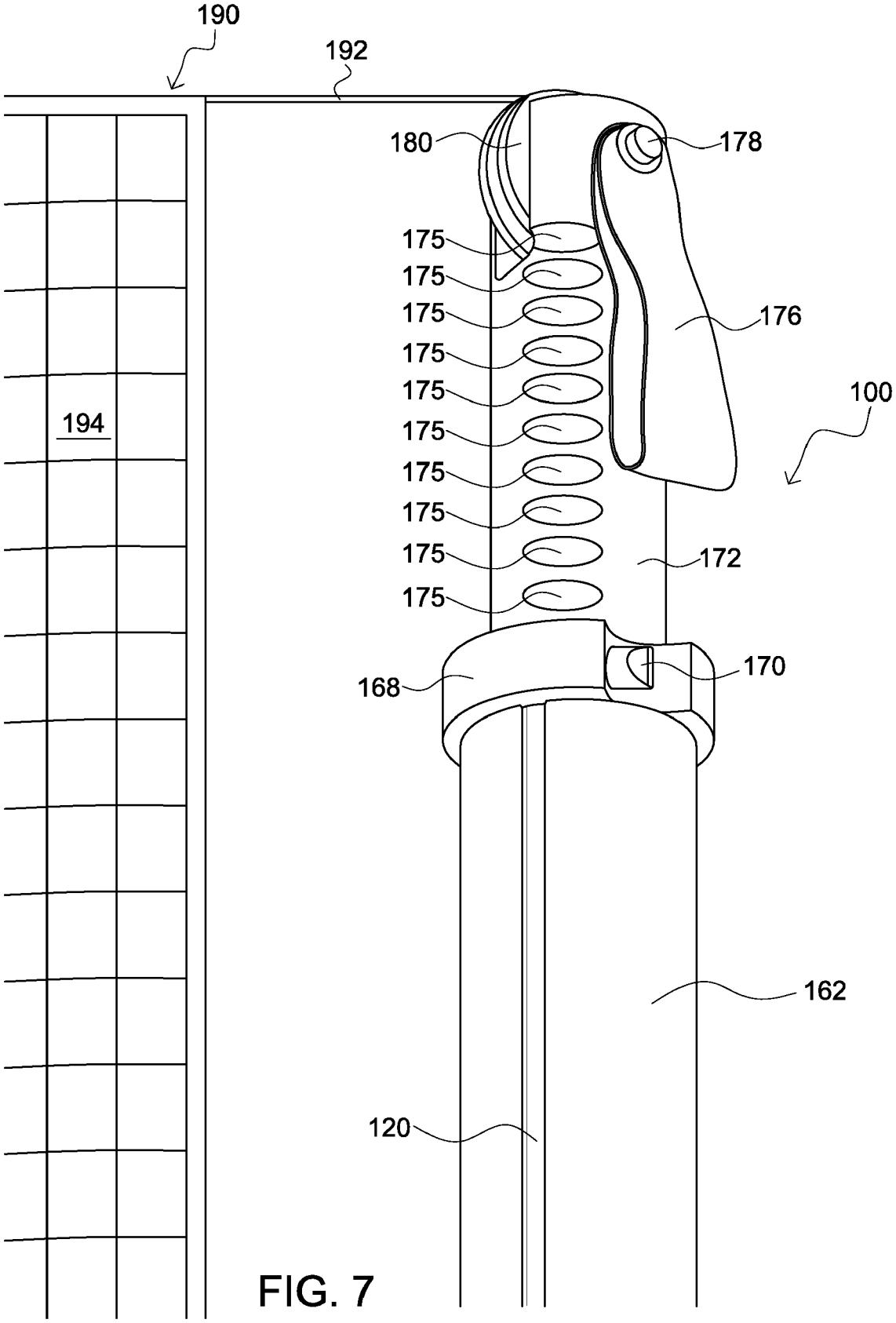
FIG. 7 is a close-up perspective view of an elongated top section of a retractable court standard according to an embodiment.

Interaction of the clamping mechanism 168 with the elongated top section 172 is illustrated with reference to FIG. 7. FIG. 7 is a close-up perspective view of the elongated top section 172 and the fourth elongated tubular section 162 of the retractable court standard 100. A plurality of notches 175 each of the notches extend generally latitudinal and have a cylindrical cutout of similar radial dimension as the cylindrical portion of the button 170 (shown in FIG. 6B). To lock the elongated top section 172 in place, the button 170 is released when a one of the notches 175 is generally aligned with the button 170 of the clamping mechanism 168. Hence, the use of the clamping mechanism 168 with the elongated top section allow minor variations in the height of a net 190 being secured by the retractable court standard 100. It is pertinent to note that describe herein is one variation of the clamping mechanism. Other clamping mechanism are contemplated that are adapted to allow the top elongated section to be fixably movable longitudinally within the fourth elongated tubular section in one embodiment or at least one of the plurality of elongated tubular sections in alternate embodiments.

Also illustrated in FIG. 7 is a net securing assembly at a top end of the elongated top section 172. The net securing assembly comprises a pulley 180 rotatably coupled to a center rod 178 within a cutout portion of the elongated top section 172. Additionally, a handle 176 is pivotalby coupled proximal an end of the center rod 178. The handle 176 can be any member or apparatus adapted to pull at least one of the plurality of elongated tubular sections. The net 190 having a net webbing portion 194 and one or more guy wires 192 can be secured by the net securing assembly and the retractable court standard 100 in general. The pulley 180 includes a guide portion or arcuate indentation around its circumferential edge surface adapted to allow the guy wire 192 to securely wrap around a segment of the pulley 180.

Figure 8:
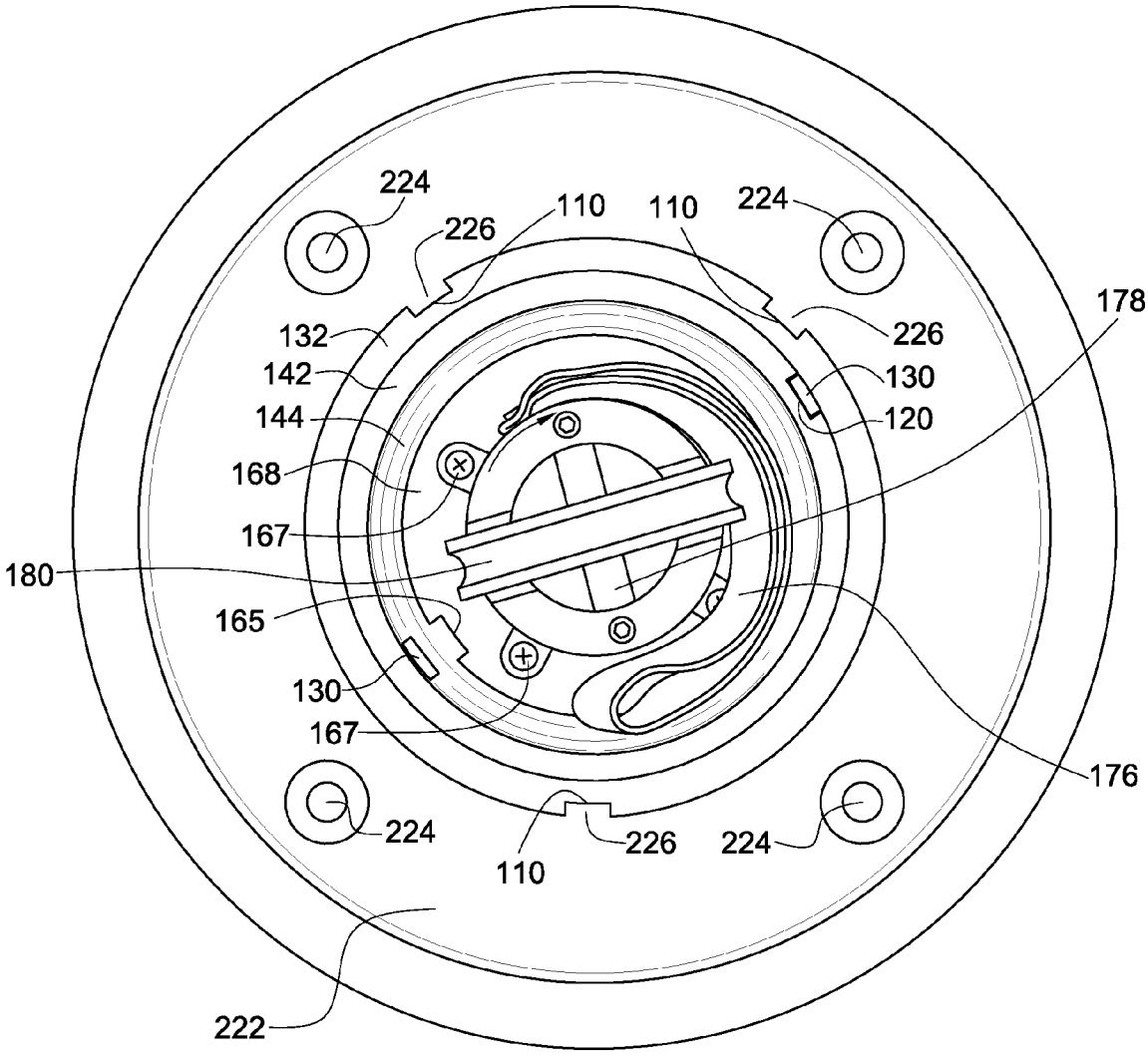
FIG. 8 is an overhead perspective view of a retractable court standard in a retracted configuration inside of a well according to an embodiment.

FIG. 8 is an overhead perspective view of the retractable court standard 100 in a fully retracted configuration inside of the well 200. The base section 222 of the well 200 is coupled to the elongated tubular well section 212 (not shown as it is subsurface within the court) via the plurality of screw 224. The three securing flanges 226 can be seen engaged within the three L type channels 110 of the first elongated tubular section 132. The top end of the first elongated tubular section 132 can be seen from the overhead perspective view as can the top end of the second elongated tubular section 142. The top ends of the first elongated tubular section 132 and the second elongated tubular section 142 are approximately the same height within the well 200. Securing pin 130 disposed on an inner surface of the first elongated tubular section 132 can be seen in the extended longitudinal channel portion of the double L-channel 120 of the second elongated tubular section 142. Moreover, the first elongated tubular section 132 and the second elongated tubular section 142 are slightly longer than the other elongated tubular sections, and thus an inner surface 144 of the second elongated tubular section 142 can be seen from the overhead perspective view. Securing pin 130 disposed on the inner surface 144 of the second elongated tubular section 142 is shown. The slot 165 on the clamping mechanism 168 can be seen substantially aligned with the securing pin 130 disposed on the inner surface 144 of the second elongated tubular section 142 thereby allowing the clamping mechanism 168 to pass through the securing pin 130 when being extended or retracted. Clamping mechanism 168 coupled with the plurality of screws 167 to the top end of the fourth elongated tubular section 162 and being slightly larger than the cross-section of the fourth elongated tubular section 162 covers the third elongated tubular section 152 (not show).

Still referring to FIG. 8, the net securing assembly at the top end of the elongated top section 172 can be seen through the inner aperture of the clamping mechanism 168. The pulley 180 pivotatably coupled to the center rod 178 within the cutout portion of the elongated top section 172 and the handle 176 fit neatly within the axial cavity of the second elongated tubular section 142 between the clamping mechanism 168 and the top end of the second elongated tubular section 142. The handle 176 can be easily accessed to pull the elongated top section 172 and the fourth elongated tubular section 162 out of the well 20 to begin the extension of the retractable court standard 100.

Figure 9:
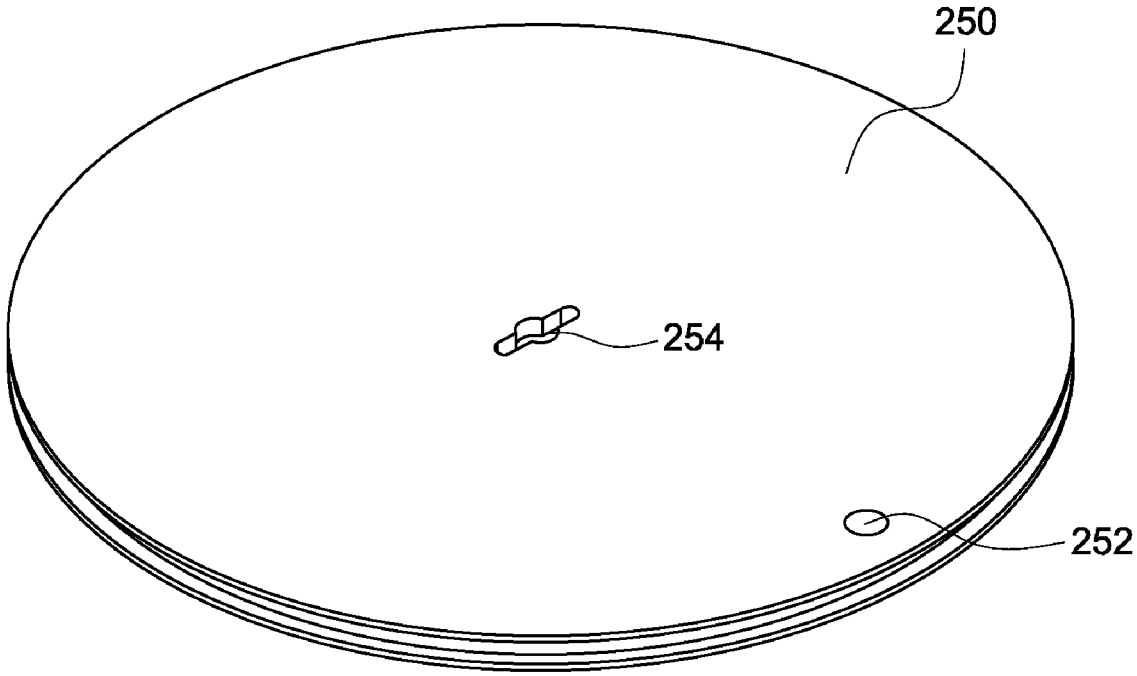
FIG. 9 is a perspective view of a cover to a well used with a retractable court standard according to an embodiment.

FIG. 9 illustrates an exemplary a cover of the well 200. Cover 250 adapted to cover the well opening includes a keyhole 254 and a bore 252. The keyhole 254 is adapted to lock the cover 250 in place over the well opening. The bore 252 is used for pivotably coupling the cover 250 with the well base section 222.

Figure 10A:
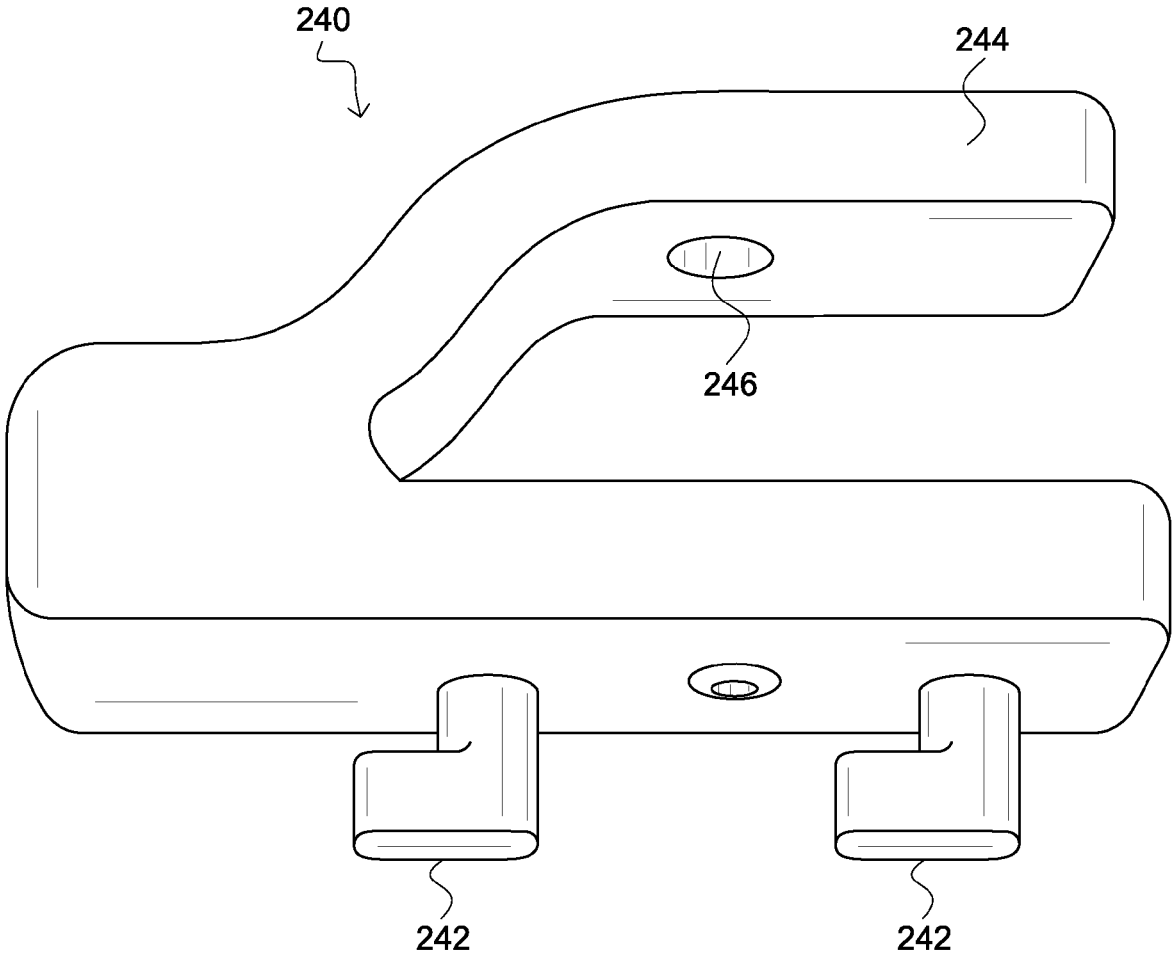
FIG. 10A is a perspective view of a hook assembly used with a retractable court standard according to an embodiment.
Figure 10B:
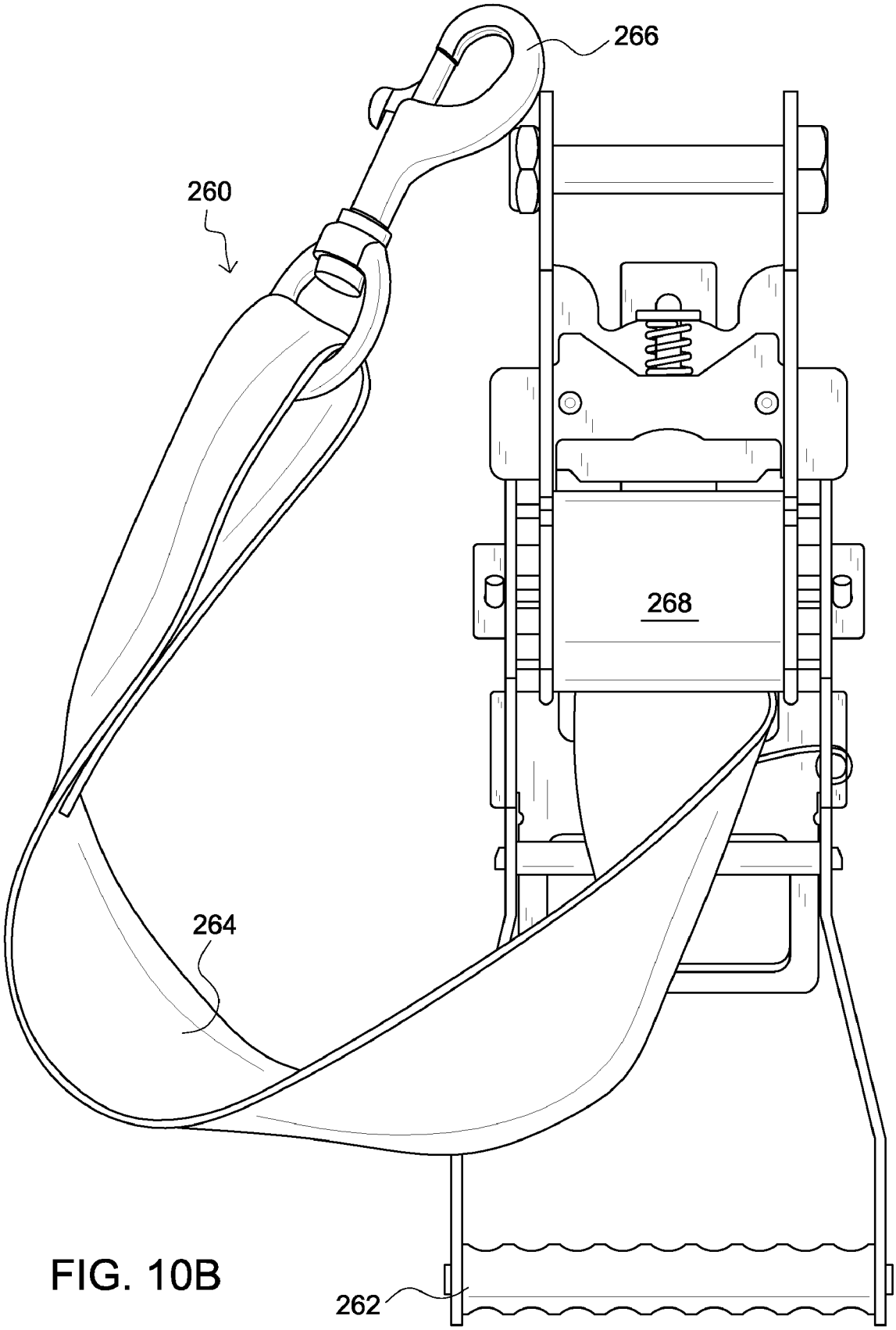
FIG. 10B is a perspective view of a winch assembly used with a retractable court standard according to an embodiment.

Exemplary accessories are illustrated in FIGS. 10A & 10B. FIG. 10A shows a hook assembly 240 including a hook appendage 244 and one or more connectors 242 adapted to be removably coupled with the third elongated tubular section 152 via the one or more bores 155. The hook appendage 244 further includes a guy wire bore 246, the guy wire bore allowing a more secure coupling of the net 190 (FIG. 7) to the retractable court standard 100. FIG. 10B shows a winch assembly 260 including a clasp 266 coupled to a strap 264. The strap 264 extends to and is secured to a wrapped around a geared spooling mechanism 286 with a releasing means. A hand crank 262 operates the geared spooling mechanism 286 such that more of the strap 264 will be wrapped around the geared spooling mechanism 286. Additionally, one or more connectors (not shown, but similar to those shown in FIG. 10A) are adapted to be removably coupled with the third elongated tubular section 152 via the one or more bores 155. It is to be appreciated that FIGS. 10A & 10B are merely exemplary and many similar variations of devices adapted to secure a net and guy wires thereof are contemplated.

An Exemplary Method of Using an Embodiment of the Retractable Court Standard

Embodiments of the retractable court standard as described above are installed within a court to secure a net and thereby establishing a court floor for a specific game or sport. Advantageously, a user can quickly extend one or more retractable court standards to create a court for playing a variety of games and sports therewith. Moreover, a user can easily retract and store the retractable court in a subsurface portion of the court. Hence, the court may be utilized for other activities while the retractable court standards remain securely and safely in the subsurface portion of the court.

Figure 11:
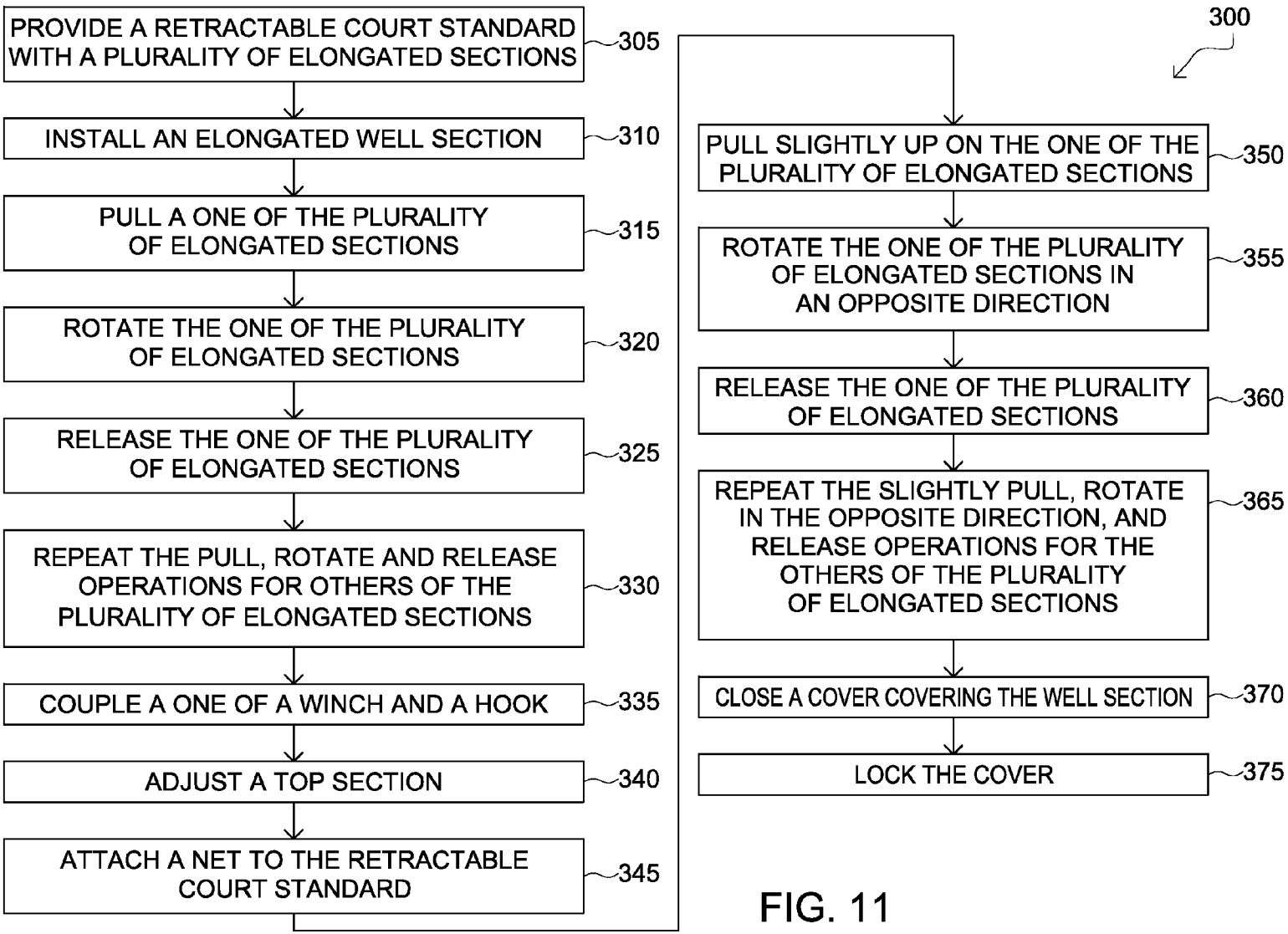
FIG. 11 is a flow chart illustrating a method of using a retractable court standard according to an embodiment.

A detailed exemplary method utilizing embodiments of the retractable court standard is illustrated in the flow chart of FIG. 11. Method 300 describes how a user can extend, retract, and store one or more retractable court standards. An operation 305 of method 300 comprises providing a retractable court standard. Various embodiments of the retractable court standard described herein can be provided pursuant to operation 305. Some operations of method 300 are more specific and better described with reference to the exemplary retractable court standard 100 and the well 200. However, method 300 is in no way limited to a specific embodiment of the retractable court standard. For example, variations of method 300 can be performed with a retractable court standard comprising a rotational locking channel that is not of the L type channel or the double-L type channel thereby eliminating the need to perform some operations specific to channel portions of L type channels and double-L type channels.

Next, a well can be installed into a court (operation 310). The well is installed substantially subsurface, if not entirely subsurface or below the court floor. Operation 310 can be omitted if no well is to be utilized with the retractable court standard or modified if a portion of the retractable court standard is to be installed substantially subsurface of the court.

As described in operation 315, a one of the plurality of elongated tubular sections can be pulled upwardly from a top end by the user, or a similar force exerted to move the one of the plurality of elongated tubular sections in an upwardly direction. Also, the one of the plurality of elongated tubular section can include the elongated top section. Moreover, the user may utilize a handle coupled to the top end of the elongated top section or otherwise to aid in extraction the one of the plurality of elongated tubular sections.

The upward sliding movement described in operation 315 achieved by the combination of at least one rotational locking channel and at least one securing pin. When the one of the plurality of elongated tubular sections is the elongated top section, the operation of pulling upwardly will typically cause the topmost of the elongated tubular sections (the fourth elongated tubular section 162 in one embodiment) to extend upwardly. The topmost of the elongated tubular sections will extend until an end of an extended longitudinal channel portion of the at least one rotational locking channel in one direction or intersection in different directions is reached. The end will be reached or engaged by the at least one of the securing pins. The at least one of the securing pins will be coupled to a circumferentially adjacent elongated tubular section.

Next, as described in operation 320, the one of the plurality of elongated tubular sections is rotated. The rotation of the one of the plurality of elongated tubular sections is generally around its axial center. The one of the plurality of the elongated tubular sections generally rotates around the axial center thereof. The at least one securing pin of another circumferentially adjacent elongated tubular section will moves along a substantially latitudinal channel portion of the at least one rotational locking channel of the one of the plurality of elongated tubular sections. In some versions of the at least one rotational locking channel, the substantially latitudinal channel portion can have a slightly upward angle and/or locking notch. However, there the at least one rotational locking channel is an L type channel or a double-L type channel, the substantially latitudinal channel portion will be near latitudinal with the axial center and will include one or more longitudinal locking channel portions.

Engagement of the one or more longitudinal locking channel portions occurs by releasing the one of the plurality of elongated tubular sections (operation 325). The releasing of the one of the plurality of the elongated tubular sections enables a secure locking of the two circumferentially adjacent elongated tubular sections (refer back to FIG. 5 and accompanying description) as an upward force of some significance is now required to disengaged and collapse/retract the two circumferentially adjacent elongated tubular sections after they have been extended.

Next, as described in operation 330, the pulling, rotating, and releasing (as necessary) operations are repeated for the others of the plurality of the elongated tubular sections until the retractable court standard is fully extended with respect to the plurality of elongated tubular sections. For instance, the aforementioned operations will be repeated for the third elongated tubular section 152, the second elongated tubular section 142, and the first elongated tubular section 132 for one embodiment of the retractable court standard.

Next, a one of a winch assembly or a hook assembly can be coupled to the retractable court standard (operation 335). For example the one of the winch assembly or the hook assembly as described above and illustrated in FIGS. 10A & 10B can be removably coupled to the one or more bores 155 located on the third elongated tubular section 152.

Next, as indicated in operation 340, the total height of the retractable court standard can be increased and/or adjusted by sliding the elongated top section 172. The elongated top section 172 can be adjusted by releasing and locking the clamping mechanism 168 coupled to the fourth elongated tubular section 162.

A net can be attached to the retractable court standard as indicated in operation 345. For example, a guy wire from the net can be coupled through a pulley of a net securing assembly and coupled to the one of the hook assembly and the winch assembly. The guy wire may be attached through two net work attached or both if two retractable court standards are utilized to secure a net as is typically the case. However, the other end of the net can be secured by a wall or other structure in conjunction with one retractable court standard.

Operation 350 begins the portion of method 300 relating to retracting and storing the retractable court standard. As described in operation 350, the one of the plurality elongated tubular section is pulled slightly up (and/or an upward for generated) as required to disengaged and collapse/retract two circumferentially adjacent elongated tubular sections after they have been extended. In some variations of the rotation locking channel, the pulling up operation may not be required as the rotation locking channel may not comprise one or more locking channel portions.

Next, the user rotates the one of the plurality of elongated tubular sections (operation 355). Operation 355 is similar to operation 320 except that the rotation would be in an opposite direction of the rotate operations for extending the elongated tubular sections.

Next, as described in operation 360, the one of the plurality of elongated tubular sections is released. Thus the one of the plurality of elongated tubular sections will slide into another circumferentially adjacent elongated tubular section. The sliding of the one of the plurality of elongated tubular sections will be guided by the at least one securing pin of another circumferentially adjacent elongated tubular section and the extended longitudinal portion of the at least one rotational locking channel.

Next, as described in operation 365, the pulling (as necessary), rotating, and releasing operations are repeated for the others of the plurality of the elongated tubular sections until the retractable court standard is fully extended with respect to the plurality of elongated tubular sections.

Next, after the retractable court standard has been fully received in the well, including retracting the elongated top section, a cover covering the well is closed (operation 370). Further, where the well is a lockable, the cover is locked with the retractable court standard within the well (operation 375).

Other Embodiments and Variations

The various embodiments and variations thereof illustrated in the accompanying figures and/or described above are merely exemplary and are not meant to limit the scope of the invention. It is to be appreciated that numerous variations to the invention have been contemplated as would be obvious to one of ordinary skill in the art with the benefit of this disclosure. All variations of the invention that read upon the appended claims are intended and contemplated to be within the scope of the invention.

For example, embodiments of the retractable court standard may additionally comprise an internal pulley system, gear system, or other mechanical means incorporated therein, either controlled manually or by electric motor adapted to automatically extend and retract the retractable court standard.

I claim:

1. A retractable court standard comprising:

a plurality of elongated tubular sections, each having a top end and a bottom end, and different diameter relative to the other elongated tubular sections; and an elongated top section having a top end and a bottom end, and a net securing assembly coupled proximal the top end;

wherein at least one elongated tubular section is slidably and rotatably disposed within another circumferentially adjacent elongated tubular section, the at least one elongated tubular section having one of at least one rotational locking channel and at least one securing pin, the circumferentially adjacent elongated tubular section having the other of the at least one rotational locking channel and the at least one securing pin;

wherein the elongated top section is coupled to and slidably disposed within a topmost of the elongated tubular sections, the topmost of the elongated tubular sections comprising a clamping mechanism operatively coupled thereto, the clamping mechanism adapted to releasably lock the elongated top section.

2. The retractable court standard of claim 1, wherein the at least one rotational locking channel includes at least one L type channel.

3. The retractable court standard of claim 1, wherein the at least one rotational locking channel includes at least one double-L type channel.

4. The retractable court standard of claim 1, wherein the elongated top section includes a plurality of notches vertically disposed thereon, each of the notches adapted to fixably engage with the clamping mechanism.

5. The retractable court standard of claim 1, wherein the net securing assembly comprises at least a pulley and a handle.

6. A retractable court standard comprising:

a plurality of elongated tubular sections, each having a top end and a bottom end, and different diameter relative to the other elongated tubular sections;

one or more O-rings, each of the O-rings being coupled to and generally encircling around an outer circumferential surface of at least one of the elongated tubular sections whereby the O-ring will be in contact with another circumferentially adjacent elongated tubular section; and an elongated top section having a top end and a bottom end, and a net securing assembly coupled proximal the top end;

wherein at least one elongated tubular section is slidably and rotatably disposed within another circumferentially adjacent elongated tubular section, the at least one elongated tubular section having one of at least one rotational locking channel and at least one securing pin, the circumferentially adjacent elongated tubular section having the other of the at least one rotational locking channel and the at least one securing pin, and the elongated top section is coupled to and slidably disposed within a topmost of the elongated tubular sections.

7. A retractable court standard system comprising:

a retractable court standard, the retractable court standard comprising, a first elongated tubular section having a top end and a bottom end;

a second elongated tubular section having a top end and a bottom end and being slidably and rotably disposed within the first elongated tubular section;

a third elongated tubular section having a top end and a bottom and being slidably and rotably disposed within the second elongated tubular section;

a fourth elongated tubular section having a top end and a bottom end and being slidably and rotably disposed within the third elongated tubular section, the fourth elongated tubular section having a clamping mechanism at the top end;

an elongated top section having a top end and a bottom end and being slidably disposed within the fourth elongated tubular section; and a net securing assembly having a pulley, the net securing assembly coupled to the top end of the elongated top section;

wherein each elongated tubular section comprises at least one rotational locking channel, each of the at least one rotational locking channel is adapted to receive at least one securing pin from another elongated tubular section with which it is slidably and rotatbly disposed; and the clamping mechanism is adapted to a (i) allow the top elongated section to slide longitudinally in a first state and (ii) prevent substantial movement between the fourth elongated tubular section and the top elongated section in a second state.

8. The retractable court standard system of claim 7 further comprising:

a well, the well having an elongated tubular section adapted to receive substantially receive the retractable court standard when the retractable court standard is in a fully retracted configuration.

9. The retractable court standard system of claim 8, wherein the well further includes a base section, the base section having at least one securing flange adapted to interface with at least one rotational locking channel.

10. The retractable court standard system of claim 9, wherein a one of the first elongated tubular section, the second elongated tubular section, and the fourth elongated tubular section has at least one least one bore through an outer surface and an inner surface.

11. The retractable court standard system of claim 9, wherein at least one of the first elongated tubular section, the second elongated tubular section, and the fourth elongated tubular section further includes (a) overlapping portions of circumferentially adjacent elongated tubular sections of four or more inches longitudinally and (b) at least one of an L type channel and a double-L type channel for the at least one rotational locking channel.

12. The retractable court standard system of claim 9 further comprising:

a one of a winch assembly or a hook assembly.

13. The retractable court standard system of claim 12 further comprising:

a net, the net including a net webbing portion and one or more guy wires;

wherein a first portion of at least one on the one or more guy wires is coupled to the pulley proximal the net webbing portion and a second portion is coupled to the one of the winch assembly or the hook assembly distal the net webbing portion.

14. A method extending the retractable court standard of claim 1 when the retractable court standard is in a fully retracted configuration and is substantially subsurface, the method comprising:

pulling upwardly on a top end of the elongated top section thereby causing the topmost of the elongated tubular sections to extend upwardly until an end of an extended longitudinal channel portion of the at least one rotational locking channel of the topmost of the elongated tubular sections engages with the at least one securing pin of a circumferentially adjacent elongated tubular section;

rotating the topmost of the elongated tubular sections generally around the axial center thereof whereby the at least one securing pin of the circumferentially adjacent elongated tubular section moves along a substantially latitudinal channel portion of the at least one rotational locking channel of the topmost of the elongated tubular sections;

pulling upwardly on a one of the topmost of the elongated tubular sections and the elongated top section thereby causing the circumferentially adjacent elongated tubular section to extend upwardly until an end of an extended longitudinal channel portion of another of the at least one rotational locking channel engages with another of the at least one securing pin of a next circumferentially adjacent elongated tubular section;

rotating the one of the topmost of the elongated tubular sections and the elongated top section substantially around the axial center thereof whereby the another of the at least one securing pin of the next circumferentially adjacent elongated tubular sections moves along a substantially latitudinal channel portion of the at least one rotational locking channel of the circumferentially adjacent elongated tubular section; and repeating said pulling upwardly and rotating operations until the retractable court standard is fully extended.

15. A method retracting the retractable court standard of claim 1 to retract the retractable court standard when the retractable court standard initially exists in a fully extended configuration, the method comprising:

releasing the elongated top section from the clamping mechanism thereby causing the elongated top section to slide substantially into the topmost of the elongated tubular sections;

rotating the topmost of the elongated tubular sections generally around the axial center thereof whereby the at least one securing pin of a circumferentially adjacent elongated tubular section moves along a substantially latitudinal channel portion of the at least one rotational locking channel of the topmost of the elongated tubular sections until the at least one securing pin of a circumferentially adjacent elongated tubular section engages an end of the substantially latitudinal channel portion of the at least one rotational locking channel of the topmost of the elongated tubular sections;

releasing the topmost of the elongated tubular sections thereby causing the topmost of the elongated tubular sections to slide substantially into the circumferentially adjacent elongated tubular section guided by the at least one securing pin of the circumferentially adjacent elongated tubular section through an extended longitudinal channel portion of the at least one rotational locking channel of the topmost of the elongated tubular sections;

rotating the circumferentially adjacent elongated tubular section around the axial center thereof whereby the at least one securing pin of a next circumferentially adjacent elongated tubular section moves along a substantially latitudinal channel portion of the at least one rotational locking channel of circumferentially adjacent elongated tubular section until the at least one securing pin of the next circumferentially adjacent elongated tubular section engages an end of the substantially latitudinal channel portion of the at least one rotational locking channel of the circumferentially adjacent elongated tubular section;

releasing the circumferentially adjacent elongated tubular section thereby causing the circumferentially adjacent elongated tubular section to slide substantially into the next circumferentially adjacent elongated tubular section guided by the at least one securing pin of the next circumferentially adjacent elongated tubular section through an extended longitudinal channel portion of the at least one rotational locking channel of the circumferentially adjacent elongated tubular section; and repeating said rotating and releasing operations until the retractable court standard is fully retracted.

* * * * *